US005179243A

United States Patent [19]

Schroeder

[11] Patent Number: 5,179,243

[45] Date of Patent: Jan. 12, 1993

[54] AMMUNITION ASSEMBLY DEVICE

[76] Inventor: George Schroeder, 13935 Purple Sage, El Paso, Tex. 79936

[21] Appl. No.: 894,324

[22] Filed: Jun. 4, 1992

[51] Int. Cl.[5] ..... F42B 33/02

[52] U.S. Cl. ..... 86/25; 86/28; 86/43; 86/45

[58] Field of Search ..... 86/23, 25, 26, 27, 28, 86/24, 45, 46, 43

[56] References Cited

U.S. PATENT DOCUMENTS

| | | | |
|---|---|---|---|
| 3,073,208 | 1/1963 | Agnese | 86/23 |
| 3,336,830 | 8/1967 | Lester | 86/43 |
| 3,483,792 | 12/1969 | Williams | 86/27 |
| 3,602,084 | 8/1971 | Corcoran | 86/43 |
| 4,228,724 | 10/1980 | Leich | 86/26 |
| 4,475,435 | 10/1984 | Mantel | 86/26 |
| 4,573,392 | 3/1986 | Mantel | 86/43 |

*Primary Examiner*—J. Woodrow Eldred
*Attorney, Agent, or Firm*—Salzman & Levy

[57] ABSTRACT

The present invention provides an automatic feed mechanism for the assembly of ammunition. Ammunition is assembled in the feed mechanism by the joining of bullets with their respective shell casings, one at a time. The automatic feed mechanism is utilized in conjunction with a progressive reloading press. The automatic feed mechanism comprises a replaceable feed tube having a precise bore. The bore is designed to accommodate the free fall of a single bullet of a given caliber for precise alignment with a shell casing of the same caliber. The precision of this alignment stems from the precise bore tolerance for a given bullet caliber, with the union of the bullet and the shell casing only under the influence only of gravitational forces. Should it be desired to join a bullet of another caliber with a shell casing of the same or different caliber, the feed tube is easily removed and replaced by one having the proper dimensions and internal bore to assemble the new ammunition.

16 Claims, 5 Drawing Sheets

AMMUNITION ASSEMBLY DEVICE

FIELD OF THE INVENTION

The present invention relates to ammunition fabrication devices for amateur gun and rifle enthusiasts, and, more particularly, to a simplified, comprehensive, automated ammunition fabrication system which can be utilized by an amateur rifle or gun enthusiast whereby bullets are placed into shell casings prior to subsequent operations, such as seating the bullet to the proper depth in the case, and thereafter crimping the case about the bullet.

BACKGROUND OF THE INVENTION

Many gun and rifle aficionados enjoy preparing their own ammunition for tournaments, target shooting and hunting. The equipment currently used for automatically aligning and/or joining bullets to the respective casings comprises a progressive reloading press. The bullet and the shell casing are usually aligned and fixed in place by hand, one at a time. A lever mechanism is actuated for joining the two parts.

In order to save on the cost of ammunition preparation, shell casings are often used more than once. Such multiple reloadings are fraught with safety problems, since wear and tear, as well as ammunition explosions, frequently distort the shell casings. When a shell casing is distorted, there is obviously difficulty in aligning it with a new bullet; such distorted casings are generally resized and trimmed. It therefore becomes necessary to exert extra care in the preparation and alignment of the bullet, as well as the handling thereof. If proper tolerance and alignment are not observed, there is danger that the newly-formed ammunition may cause damage or injury to both the shooter and the gun itself.

Current press devices are usually constructed to unite only certain sizes of bullet and shell case.

An apparatus that could provide an automatic means for placing and aligning the bullet within the shell casing to a close tolerance would be quite welcome to the amateur. Such an apparatus would provide a much faster process than is currently available, as well as one having an extra margin of safety.

It is also desirable that such a device utilize the already existing press loading equipment, so that the cost of reloading would not be appreciably increased.

In addition, such an invention would be advantageous to those enthusiasts having more than one firearm, if the device were able to process and load bullets and shells of varying sizes.

The present invention seeks to achieve all of the above cited objectives, as well as other objectives which will become more apparent with reference to the subsequent, detailed description.

DISCUSSION OF THE RELATED ART

In U.S. Pat. No. 4,475,435, issued to Mantel on Oct. 9, 1984, for: IN LINE BULLET FEEDER, a bullet feed assembly comprising a progressive reloading press for loading ammunition is shown. The bullet feed assembly contains a reservoir having a plurality of tandem disposed bullets mounted atop a tubular housing. The tubular housing has a central bore that receives one bullet at a time from the reservoir. A shell casing is inserted at the bottom of the tubular housing's bore, thus releasing a first set of camming members holding the bullet captured therein. The released bullet is forced into the open neck of the shell casing, while the casing is being advanced upwards. A second set of camming members disposed atop the first set of camming members prevents any backward movement of the bullet while the casing is advancing upwards. The bullet subsequently joins with the shell casing, when the casing is removed from the bore downwards. The removal of the assembled ammunition allows the next bullet in line to drop into the place vacated by the one removed. The new bullet is held in place by the first set of camming members for assembly with the next casing entering the bore, and the process is repeated.

The above method of assembly differs from the present invention in that the double sets of camming members make this system more intricate and more costly than is necessary to accomplish the union of the bullet and the casing.

The current invention uses a different principle in the alignment of the bullet with the shell casing. The new principle eliminates securing the bullet while it is joined to the shell casing; this greatly reduces the probability of bullet misalignment. This invention employs a free-falling bullet that is guided into a precisely toleranced bore. The free-falling bullet drops into a shell casing, which is secured in the precisely toleranced bore. In this manner, alignment is more precise, with the chance of a cocked or crooked alignment minimized.

In U.S. Pat. No. 4,573,392, issued to Mantel on Mar. 4, 1986, for: IN-LINE BULLET FEEDER, a similar mechanism to the aforesaid device of U.S. Pat. No. 4,475,435 is shown. This patent realizes the need to improve the alignment of the joined pieces by introducing three detent balls in place of each of the camming sets. While the detent balls provide point contact with the bullet, they still do not solve the problems of: (a) the possible cocking or misalignment of the bullet as the shell is forced in place, (b) the need to change the entire mechanism when ammunition of a different size is to be assembled c) it is a complicated expensive mechanism to manufacture.

SUMMARY OF THE INVENTION

In accordance with the present invention, there is provided an automatic feed mechanism for the fabrication of ammunition. Ammunition is assembled in the feed mechanism by the joining of bullets with their respective shell casings, one at a time. The automatic feed mechanism is utilized in conjunction with a progressive reloading press. The automatic feed mechanism comprises a replaceable feed tube having a precise bore. The bore is designed to accommodate the free fall of a single bullet of a given caliber (diameter) for precise alignment with a shell casing for the same caliber. Thereafter, the bullet and shell casing can be properly seated in a subsequent operation. The precision of the alignment of this invention stems from the precise bore tolerance provided by the invention for a given bullet caliber, with the union of the bullet and the shell casing under the influence only of gravitational forces. Should it be desired to join a bullet of another caliber with a shell casing of the same or different caliber, the feed tube is easily removed and replaced by one having the proper dimensions and internal bore to assemble new ammunition. The feed tube is mounted to a cylindrical housing that accommodates a plurality of bullets disposed tandem therein. The cylindrical housing supports two detent pins that reciprocally move in and out of the cylindrical housing by sliding. The detent pins provide a single feed of bullets, i.e., a free fall of one bullet at a time to the feed tube positioned below. A camming piston actuated by the progressive reloading press reciprocally moves up and down to engage a trip lever that engages the detent pins. When engaged and disengaged, the lever causes reciprocation of alternate detent pins.

In an alternate embodiment, the detent pins are replaced by a sliding shuttle carrier, with the feed tube offset from the cylindrical housing. The camming piston actuates the trip lever to slide the shuttle carrier from its alignment with the cylindrical housing to an alignment with the feed tube. One bullet at a time drops from the cylindrical housing into this sliding shuttle carrier. The bullet rests there until it is positioned over the feed tube for purposes of its free-fall union with a shell casing. Return of the shuttle carrier to its aligned position with the cylindrical housing allows a subsequent bullet to drop therein, and the process is repeated.

In a further embodiment, the detent pins are mounted directly onto the trip lever. The trip lever has pivotable movement and so pivots when engaged by the camming piston. The pivoting of the lever alternately moves each detent in and out of engagement with the lowermost bullet disposed in the cylindrical housing, thus allowing the bullet to drop into the feed tube. As the lowermost bullet drops, it is replaced by the next bullet in line.

In still another embodiment, the movement of the shell casing into the feed tube forces the feed tube to move upwards. This upward movement of the feed tube causes a spring detent mounted thereto to engage a pivotable lever. When caused to pivot by said spring detent, the lever acts like a pawl to drop one bullet from a stack of bullets disposed therein.

All of the aforementioned embodiments function with a free-falling bullet feed tube to prevent misalignment of the joined pieces. In addition, the feed tube of each embodiment can be easily replaced to accommodate bullets and/or shell casings of different calibers.

BRIEF DESCRIPTION OF THE DRAWINGS

A complete understanding of the present invention may be obtained by reference to the accompanying drawings, when taken in conjunction with the detailed description thereof and in which.

DESCRIPTION OF THE PREFERRED EMBODIMENT

Generally speaking, the invention features a reloading apparatus for assembling ammunition. The reloading apparatus utilizes and is actuated by a progressive reloading press. The principle of operation of the reloading apparatus is contingent upon a precisely bored feed tube, wherein successive bullets are dropped into fixed shell casings one at a time. The bore of the feed tube can be sized to accommodate precise bullet tolerances; when the caliber is within the corresponding diameter range thereof, there is no need for a feed tube change. This is accomplished via an air bleed mechanism that allows for the free fall of the bullet through the bore. Moreover, the feed tube is easily removable, and it can be substituted by a feed tube accommodating yet another bullet caliber and/or case size. In addition to these advantages, the automatic feed mechanism features fewer moving parts than other, similar types of automatic feed mechanisms.

Figure 1C:
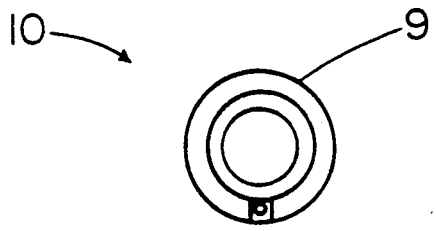
FIGS. 1*a*, 1*b*, 1*c* and 1*d* are, respectively, front, sectional, top and bottom views of a typical bullet feed tube of this invention.
Figure 1B:
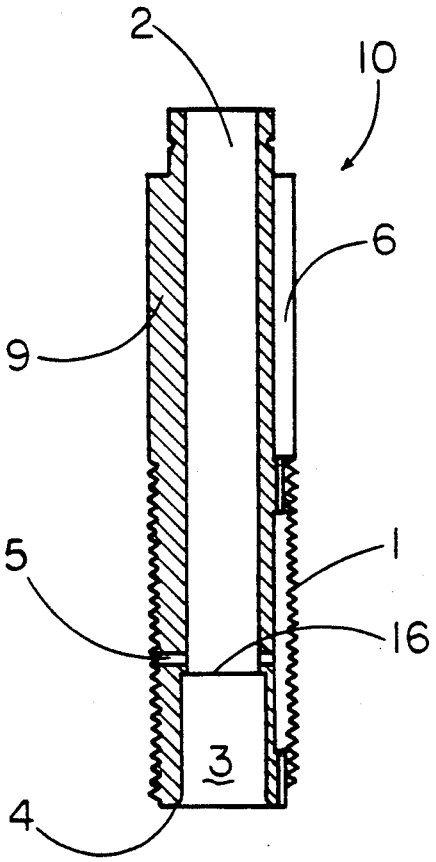
Figure 1A:
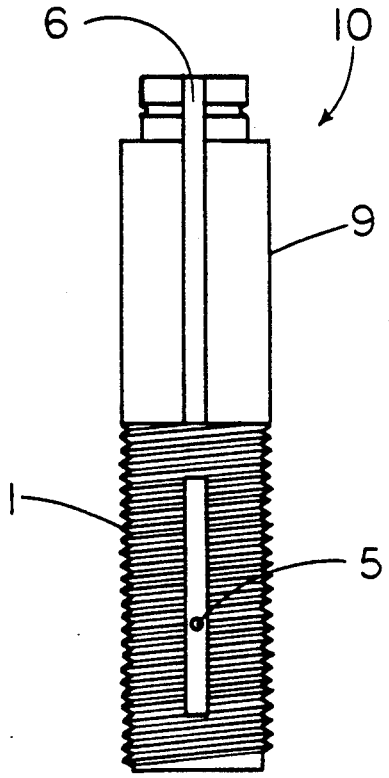
Figure 1D:
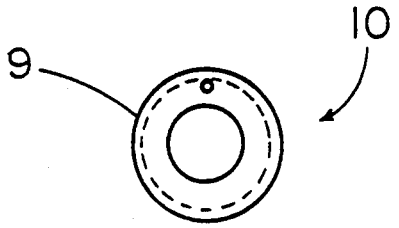
Figure 2:
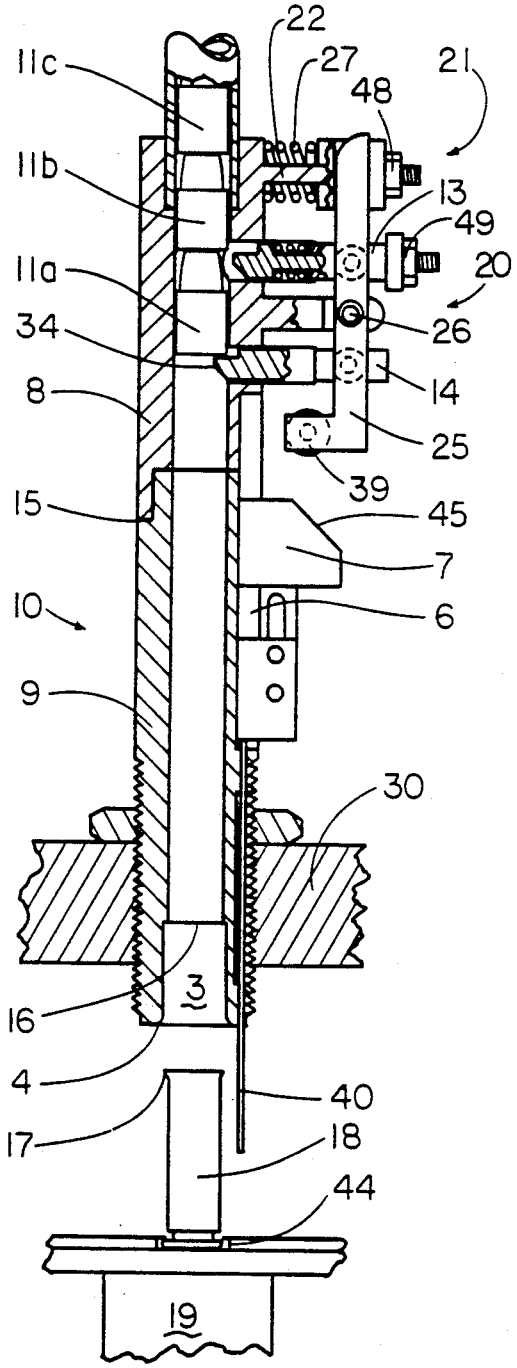
FIG. 2 illustrates a sectional view of the feed tube of FIG. 1, as mounted within a first embodiment of an automatic feed mechanism in conjunction with a progressive reloading press, with the automatic feed mechanism being illustrated in a first, initial position.
Figure 3:
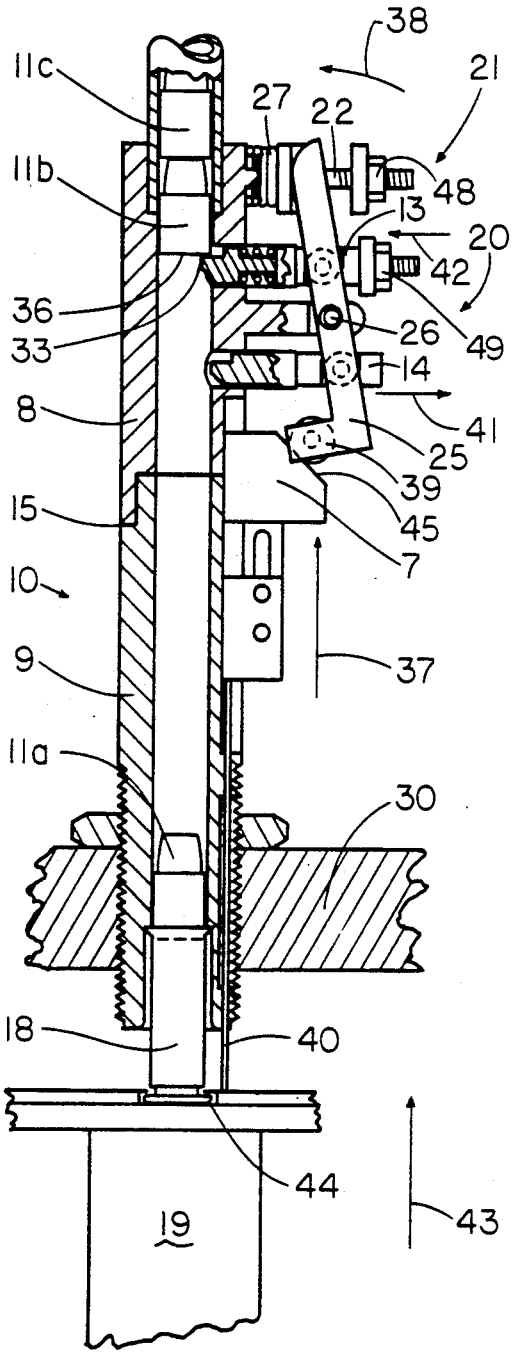
FIG. 3 depicts a sectional view of the apparatus of FIG. 2 in a second, loading position.

Now referring to FIGS. 2 and 3, an automatic feed mechanism 20 for assembling ammunition is illustrated. The automatic feed mechanism 20 is mounted in a top plate tool station 30 of a progressive reloading press. A plurality of bullets (11*a*, 11*b*, 11*c*, etc.) are fed in tandem from an upper cylindrical chamber 8 to a lower feed tube 10 comprising chamber 9. The feeding of single bullets 11 to the lower feed tube 10 is accomplished by means of the reciprocating mechanism 21.

Reciprocating mechanism 21 consists of two push pins (13 and 14, respectively). Push pins 13 and 14 are mounted upon a pivotable lever 25 that pivots about pivot fulcrum 26. A threaded rod 22 is fixedly mounted to cylindrical chamber 8. A spring 27 disposed on threaded rod 22 when lever 25 is pivoted counterclockwise (arrow 38), acts to return lever 25 to a clockwise position, as illustrated in FIG. 2. Nut 48 is used to adjust the return position of lever 25. This bullet 11*b* is only held in place by push pin 13, whose lip 33 engages the base 36 of adjacent bullet 11*b*.

The lowermost bullet 11*a* in chamber 8 of FIG. 2 is prevented from falling into lower chamber 9 by the lip 34 of push pin 14, while the upper, adjacent bullet 11*b* is freely positioned in chamber 8. The distance between lips 33 and 34 is adjusted to be exactly or slightly less than the length of the bullets 11*a*, 11*b*, 11*c*, etc.

Pivotable lever 25 has a camming wheel 39 disposed on its lower end, as shown. The camming wheel 39 is engageable by the inclined surface 45 of the piston 7 that moves upwards (arrow 37) when push rod 40 is engaged by ram 19, as depicted in FIG. 3.

When lever 25 pivots (arrow 38) about fulcrum 26, under the actuation of upwardly moving piston 7, the push pin 13 is biased toward chamber 8 (arrow 42). This holds upper bullet 11*b* in place, while the lowermost bullet 11*a* is released by push pin 14, which is pulled to the right (arrow 41) by lever 25 (FIG. 3). When the traveling piston 7 drops back to its rest position shown in FIG. 2, the lever 25 pivots back to its upright position, and the upper bullet 11*b* drops into the place vacated by the formerly lowermost bullet 11*a*. Bullet 11*b* now becomes the lowermost bullet, while adjacent bullet 11c takes its place in the tandem line. In this fashion, one bullet at a time is released into feed tube 10.

When released, bullet 11a (FIG. 3) falls into and through chamber 9 to engage with shell casing 18, which has been thrust into lower bore 3 in the feed tube 10 by upwardly moving (arrow 43) ram 19.

A new shell casing 18 is positioned in the well 44 of ram 19 every time that the ram returns to the rest position depicted in FIG. 2. In this way, there is always a shell casing 18 waiting for the next bullet to drop through feed tube 9.

Lever 2 will always return to the upright position illustrated in FIG. 2, under the biasing action of spring 27 which expands from the compressed position depicted in FIG. 3.

Referring to FIGURES 1a, 1b, 1c and 1d, the feed tube 10 used in the automatic feed mechanism of FIGS. 2 and 3 is illustrated in greater detail. The feed tube 10 comprises an elongated, cylindrical tube 9 having an internal bore 2. Bullets are gravity-fed through the bore 2 of the feed tube 10. The bore 2 is designed to precisely fit the circumferential size of the bullet, with just enough clearance to allow its free fall through the feed tube 10. To facilitate the free fall in a tightly toleranced bore 2, an air bleed conduit 5 is disposed in the bottom portion of cylindrical tube 9. At the bottom of bore 2 is a slightly larger, lower bore 3. The lower bore 3 is shaped to receive and affix the upper portion of a matching shell casing 18 (FIG. 2). In order that the shell casing 18 is easily introduced into lower bore cavity 3, there is provided a small tapering radius 4 in the bottom of the lower bore 3. The lip 17 (FIG. 2) of the shell casing 18 is caused to be thrust into lower bore 3 until it reaches the interface 16 between the two bores. The falling bullet 11 meets the shell casing 18 at interface 16 and falls into and unites with the shell casing 18. The shell casing 18 has been previously sized (expanded) by an expansion die in a prior press tool operation, in order to receive the falling bullet. The kinetic energy of the bullet as it falls through chamber 9 causes the bullet to snugly dispose itself within the throat of the shell casing. The bullet 11 is subsequently seated to proper depth within the casing 18 and the casing 18 is then crimped about the bullet 11 to form a completed ammunition round.

The feed tube 10 has outer screw threads 1 which screw into the top plate 30 of the tool station, as shown in FIG. 2. These threads 1 are standard $\frac{7}{8}\times 14$ NF. A keyway guide 6 is used to guide the upward movement of piston 7, which rides on the outer surface of chamber 9. Chambers 8 and 9 connect with a snug fit at interface 15, as illustrated in FIG. 2. Two set screws (not shown) are engageable with the upper portion of chamber 9 to facilitate mating of two chambers 8 and 9. The feed tube 10 is easily removable, so that it can be replaced by another feed tube accommodating different bullet and/or shell casing sizes. The upper chamber 8 has a large bore to accommodate the insertion of a sleeve (not shown) to change the apparatus in order to accommodate different bullet calibers. In order for the reciprocating mechanism to work properly, however, adjustment screws 48 and 49 must be turned, to allow for different push pin travel tolerance.

Figure 4:
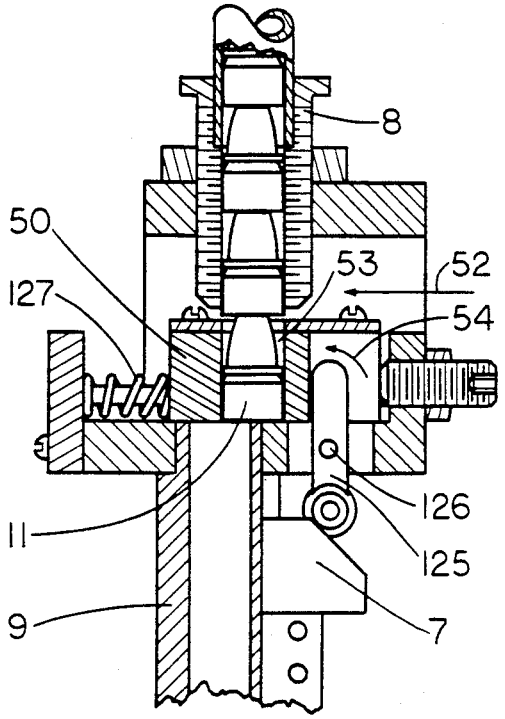
FIGS. 4 and 5 illustrate sectional views of a second embodiment of the apparatus of FIG. 2, in, respectively, initial and loading positions.
Figure 5:
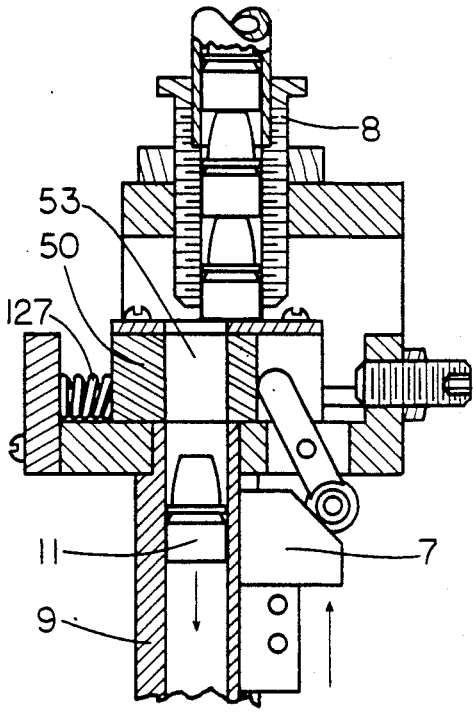

Referring to FIGS. 4 and 5, an alternate embodiment for the reciprocating mechanism 21 of the automatic feed mechanism 20 is illustrated. The push pins have been replaced by a sliding shuttle carrier 50, which slides to the left (arrow 52) as trip lever 125 is caused to pivot counterclockwise (arrow 54) about the fulcrum 126. Chamber 9 is now offset from chamber 8, so that the bullet 11 will only be fed to chamber 9 when the shuttle carrier 50 is in its most leftward position, as illustrated in FIG. 5. The camming piston 7 actuates the trip lever 125 to push the sliding shuttle carrier 50 from its alignment with the cylindrical housing 8 to an alignment with the feed tube 10. One bullet at a time drops from the cylindrical housing 8 into the sliding shuttle carrier 50, where it rests until it is positioned over the feed tube 10 for free-fall union with a shell casing 18. Return of the shuttle carrier 50 to an aligned position with the cylindrical housing 8 allows a subsequent bullet 11 to drop into the feed tube, and the process is repeated. The shuttle carrier 50 has a cavity 53 into which one bullet at a time will be deposited from chamber 8. The shuttle carrier 50 and the lever 125 will return to their most rightward position, as shown in FIGURE 4, under the action of compressed spring 127. A new bullet 11 will drop into cavity 53, and the process is repeated.

Figure 6:
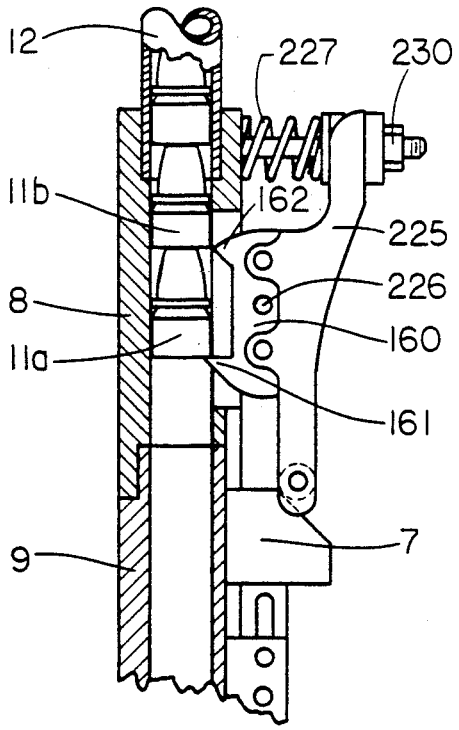
FIGS. 6 and 7 depict sectional views of a third embodiment of the apparatus of FIG. 2, in both initial and loading positions, respectively.
Figure 7:
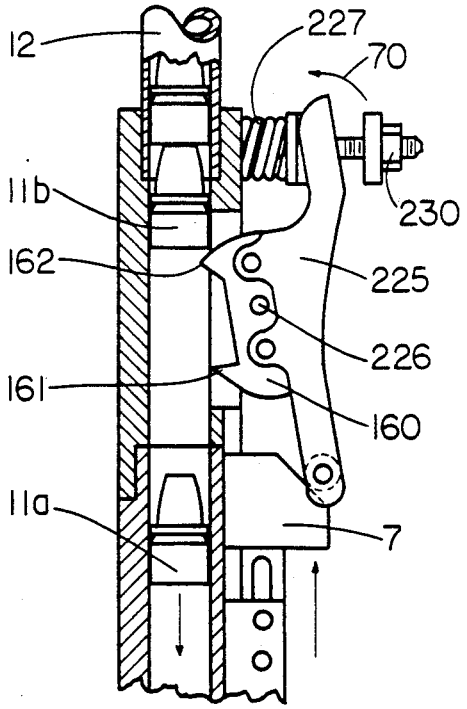

Referring to FIGS. 6 and 7, a third embodiment of the invention is shown. The push pins of FIGS. 2 and 3 have been replaced by a ratchet-like pawl 160 that is integrally mounted to pivotable lever 225. The lower tooth 161 of the pawl 160 keeps the bullet 11a from falling into chamber 9, as illustrated in FIG. 6. As the lever 225 is caused to pivot counterclockwise (arrow 70) about fulcrum 226, the lower tooth 161 of the pawl 160 no longer supports the bullet 11a and is allowed to drop from chamber 8 into chamber 9. As this is being accomplished, the upper tooth 162 of pawl 160 extends itself into the bore of chamber 8 to prevent the next bullet 11b from falling.

The pivoting lever 225 compresses spring 227, as shown in FIG. 7, thus assuring the lever's return to the rest position of FIG. 6. Adjustment nut 230 positions, depending on a given bullet caliber, the penetration of lower tooth 161 of pawl 160 into the bore of chamber 8. This device is actuated by piston 7 and operates in similar fashion to the apparatus of FIG. 2.

Figure 8:
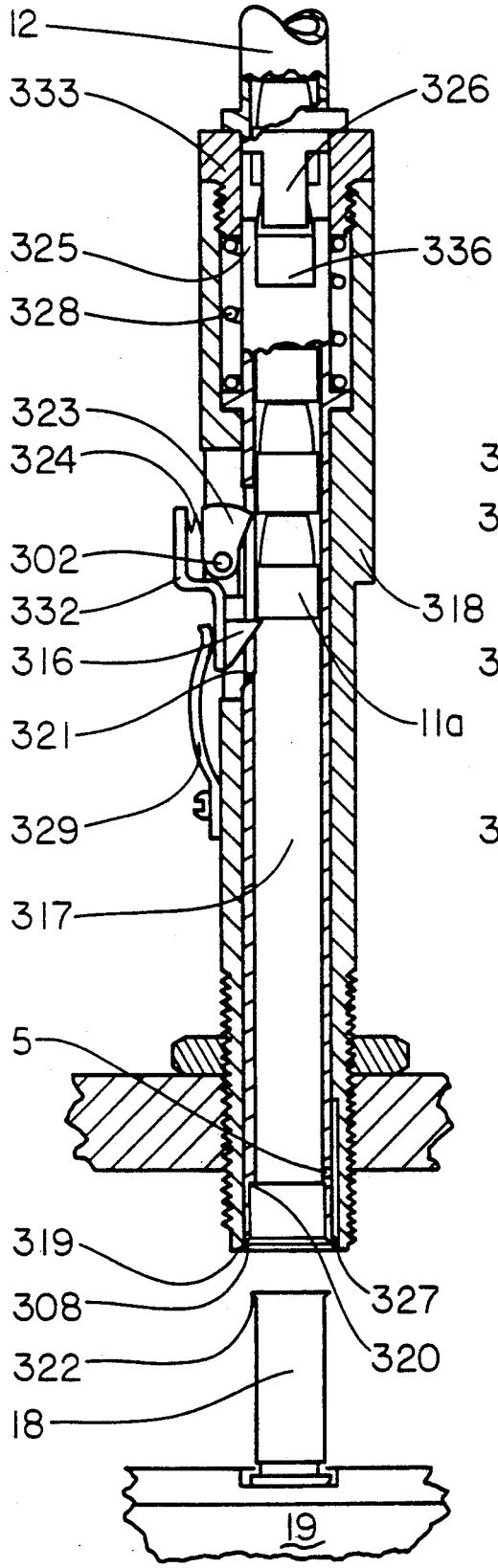
FIGS. 8 and 9 show sectional views of a fourth embodiment of the apparatus of FIG. 2 having a sliding drop tube that also functions as an actuating mechanism. This embodiment is illustrated in both initial and loading positions, respectively.
Figure 9:
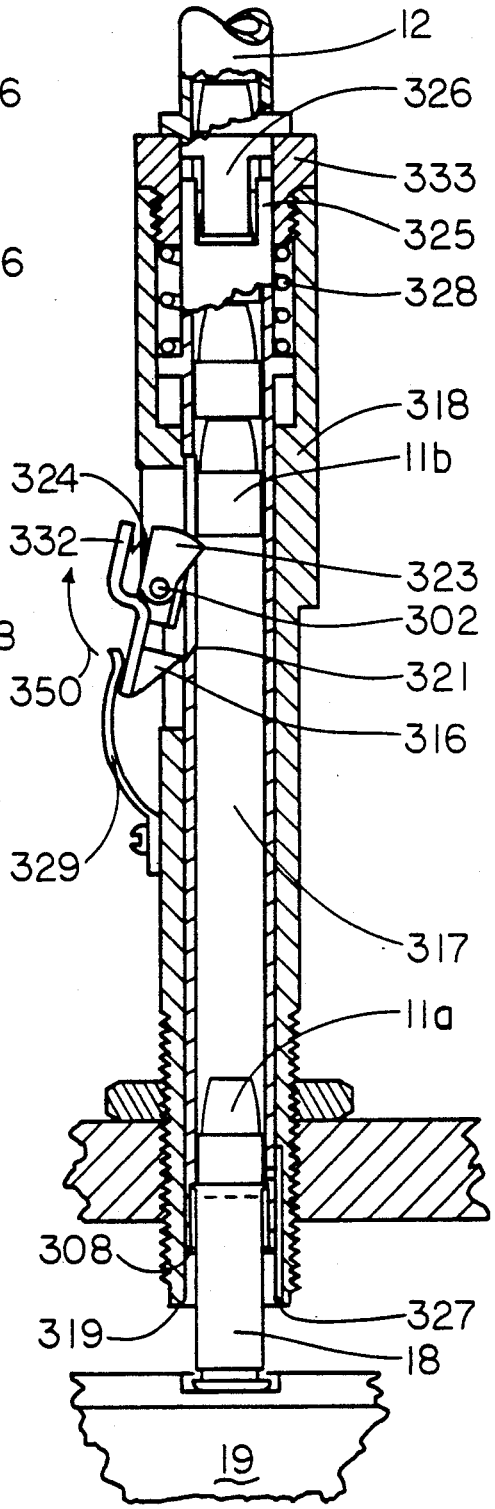

Referring to FIGS. 8 and 9, a fourth embodiment is shown for the automatic feed mechanism of FIG. 2. This embodiment features a sliding drop tube 317, which also acts as an actuating mechanism. The drop tube 317 slides upwardly inside the housing 318, when the ram 19 of the press raises the shell casing 18. Bevel 319 in the bottom of housing 318 and bevel 308 in the bottom of drop tube 317, as depicted in FIG. 8, aid in guiding the bell-shaped lip 322 of shell casing 18 into the drop tube 317, as shown in FIG. 9.

As the shell casing 18 is caused to rise under the influence of the upwardly moving ram 19, the shell casing 18 engages lip 320 of the drop tube 317, causing the drop tube 317 to move upwards, as illustrated in FIG. 9. This, in turn, causes the beveled edge 321, disposed in a mid-portion of the drop tube 317, to engage with a release cam 316. The release cam 316, which is biased by spring 329, is then caused to rotate clockwise (arrow 350, FIG. 9) about its pivot 302 and against leaf spring 329. The pivoting (arrow 350) of release cam 316 will allow the bullet 11a, held by the release cam 316 as shown in FIG. 8, to drop into shell casing 18, as illustrated in FIG. 9. When the release cam 316 is caused to pivot, it, in turn, will cause attached arm 332 to compress spring 324, causing the stop cam 323 to pivot about pivot 302 and engage the lower lip of the subsequent bullet 11*b* (FIG. 9), thus preventing the passage of subsequent bullets in the drop tube 317. Return of the release cam 316 to its counterclockwise position, as illustrated in FIG. 8, is accomplished by the bias urging of leaf spring 329, which, in turn, allows the lip of the release cam 316 to engage with the subsequent bullet 11*b*, the subsequent bullet 11*b* is then released by stop cam 323 as it pivots to its initial unbiased position (depicted in FIG. 8) as the spring 324 is decompressed by the counterclockwise pivoting of release cam 316.

The upward movement of the drop tube 317, caused by the rising shell casing 18, is biased downwardly by coil spring 328, which is disposed between the drop tube 317 and the threaded base cylinder 333. The base cylinder 333 forms part of a loading magazine apparatus. The upper portion 325 of the drop tube 317 comprises a recess 336 that remains in engagement with the extended portion 326 of the magazine tube 12. This ensures that the bullets entering the drop tube will be properly aligned.

This embodiment will not release a bullet unless a shell casing 18 is present to receive it, since the drop tube 317 will not be moved upwards unless a shell casing 18 engages lip 320 of the drop tube 317.

As previously described, air bleed hole 5 in drop tube 317 allows the air to escape as each bullet falls through the drop tube 317. Air bleed hole 5 will be in coincident position with hole 327 of jacket 318 in the actuated drop position, as illustrated in FIG. 9.

Figure 10A:
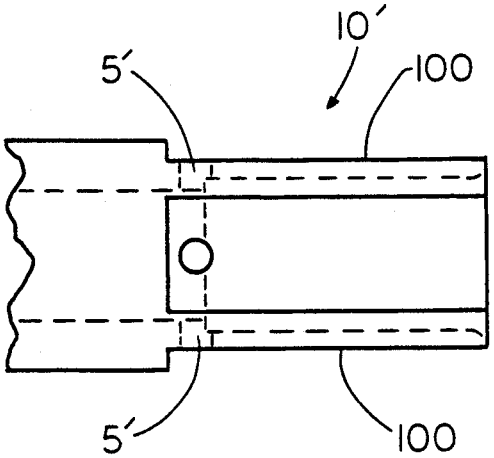
FIGS. 10*a* and 10*b* illustrate enlarged, front and bottom views respectively of the feed tube depicted in FIGS. 8 and 9.
Figure 10B:
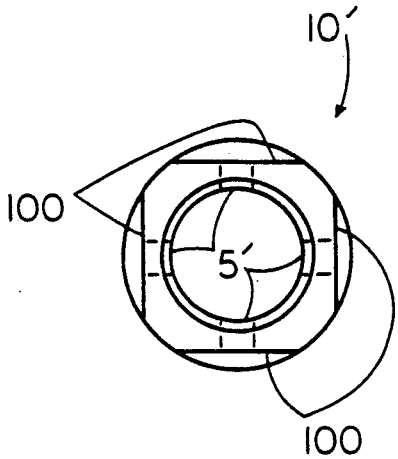

Referring to FIGS. 10*a* and 10*b*, respective front and bottom views of the feed tube 10 is depicted. The new feed tube 10' comprises four symmetrically spaced air bleed holes 5'. The symmetrical placement of the air bleed holes 5' has been found to provide for a more uniform escape of air from feed tube 10', when a bullet 11 drops therethrough. Four lands 100 machined in the feed tube 10' adjacent the air bleed holes 5' assist in the release of the exiting air. This arrangement eliminates the need for the previous embodiment wherein the bleed hole 5 must be aligned with the vent in the outer jacket.

It should also be noted that the escaping air not only allows the bullets to drop into the shell casing but it also causes a centering of the bullet within the bore of the feed tube, as some of it rushes upwards, past the falling bullet; this ensures precise alignment with the shell casing.

Figure 11B:
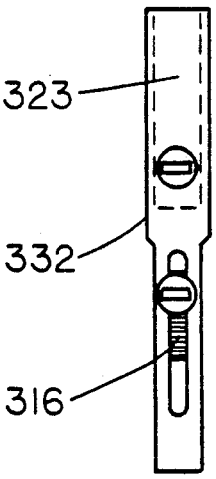
FIGS. 11*a*, 11*b*, and 11*c* depict enlarged, front, left side and right side views, respectively, of the actuating camming device depicted in FIGS. 8 and 9.
Figure 11A:
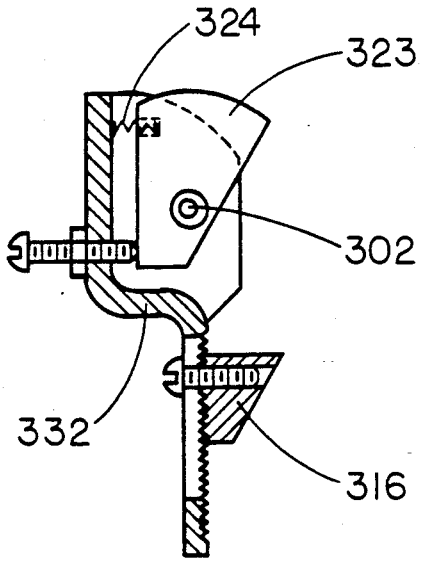
Figure 11C:
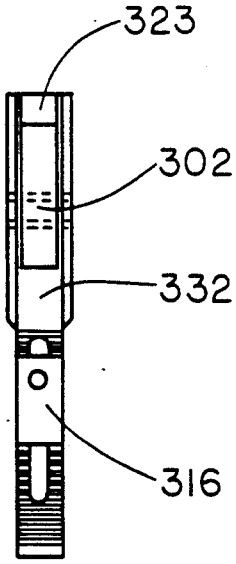

Referring to FIGURES 11*a*, 11*b* and 11*c*, there are respectively illustrated enlarged, front, left side and right side views of the actuating camming mechanism depicted in the alternate embodiment illustrated in FIGS. 8 and 9. This camming mechanism can also be adapted to work with the embodiment shown in FIGS. 6 and 7.

Since other modifications and changes varied to fit particular operating requirements and environments will be apparent to those skilled in the art, the invention is not considered limited to the examples chosen for purposes of disclosure, and covers all changes and modifications which do not constitute departures from the true spirit and scope of this invention.

Having described the current invention, what is desired to be protected by Letters Patent is presented by the subsequently appended claims.

What is claimed is:

1. A reloading apparatus for assembling ammunition, said reloading apparatus utilized in conjunction with a progressive reloading press, comprising:

a feed tube for accommodating the feeding of bullets of a given caliber, said feed tube having an inner bore of precise tolerance to said given caliber, wherein bullets can thereby drop through said feed tube one at a time under the influence of gravity to a shell casing disposed in a lower portion of said feed tube, with each bullet dropping through said feed tube being precisely aligned with a respective shell casing, as a result of said precise tolerance of said inner bore and a joining of said bullet and shell casing under influence of gravity, said feed tube further having means for allowing air to exit from said inner bore as each bullet drops through said feed tube, to facilitate passage of each bullet through said feed tube;

means for easily mounting said feed tube to a progressive reloading press, said progressive reloading press comprising means for disposing a shell casing in a lower portion of said feed tube; and actuating means disposed between the feed tube and said reloading press for actuating release of bullets one at a time for passage through said feed tube to said shell casing.

2. The reloading apparatus of claim 1, wherein said means for easily mounting said feed tube to a progressive reloading press comprises threads disposed upon said feed tube for mounting said feed tube to a table of said progressive reloading press.

3. The reloading apparatus of claim 1, wherein said actuating means for actuating release of bullets one at a time for passage through said feed tube comprises a chamber having a plurality of bullets disposed in tandem, with a pivotable lever disposed opposite said chamber, and a piston for engaging and causing said pivotable lever to pivot between a first, rest position and a second, release position.

4. The reloading apparatus of claim 3, wherein said chamber and said feed tube are offset from each other, said actuating means further comprises a shuttle carrier engageable with said pivotable lever and being slidably movable between said chamber and said feed tube, said shuttle carrier having a cavity for receiving a bullet from said chamber when said pivotable lever is in said first, rest position, and for releasing said bullet to said feed tube when said pivotable lever is in said second, release position.

5. The reloading apparatus of claim 3, wherein said actuating means further comprises a first push pin and a second push pin, each push pin being engageable by said pivotable lever and extending into said chamber to engage a respective bullet disposed therein, said first push pin releasing lowermost bullet disposed in said chamber, and said second push pin holding an adjacent bullet disposed above said lowermost bullet against release when said pivotable lever is in the second, release position, and said second push pin releasing said adjacent bullet to a position vacated by said lowermost bullet and said first push pin holding said adjacent bullet against release from said chamber when said pivotable lever is in the first, rest position.

6. The reloading apparatus of claim 3, wherein said pivotable lever further comprises a pawl having a first tooth and a second tooth, with each tooth extending into said chamber for engagement with a respective bullet disposed therein, said first tooth of said pawl releasing a lowermost bullet disposed in said chamber, and said second tooth of said pawl holding an adjacent bullet disposed above said lowermost bullet against release when said pivotable lever is in the second, release position, and said second tooth releasing said adjacent bullet to a position vacated by said lowermost bullet and said first tooth holding said adjacent bullet against release from said chamber when said pivotable lever is in the first, rest position.

7. The reloading apparatus of claim 1, wherein said actuating means for actuating release of bullets one at a time for passage through said feed tube comprises a chamber having a plurality of bullets disposed in tandem, with said chamber being disposed above said feed tube, a jacket for containing said chamber in juxtaposition with said feed tube, said feed tube being slidable within said jacket, a pivotable lever disposed opposite said chamber, with said feed tube being slidable into engaging said pivotable lever and causing said pivotable lever via sliding to pivot between a first, rest position and a second, bullet release position.

8. The reloading apparatus of claim 7, wherein said pivotable lever further comprises a pawl having a first tooth and a second tooth, with each tooth extending into said chamber for engagement with a respective bullet disposed therein, said first tooth of said pawl releasing a lowermost bullet disposed in said chamber, and said second tooth of said pawl holding an adjacent bullet disposed above said lowermost bullet against release when said pivotable lever is in the second, release position, and said second tooth releasing said adjacent bullet to a position vacated by said lowermost bullet and said first tooth holding said adjacent bullet against release from said chamber when said pivotable lever is in the first, rest position, said feed tube slidably engaging said pivotable lever for movement between said first, rest position and said second, release position.

9. A reloading apparatus for assembling ammunition, said reloading apparatus utilized in conjunction with a progressive reloading press, comprising:

a feed tube for accommodating the feeding of bullets of a given caliber, said feed tube having an inner bore of precise tolerance to said given caliber, wherein bullets can thereby drop through said feed tube one-at-a-time under the influence of gravity to a shell casing disposed in a lower portion of said feed tube, with each bullet dropping through said feed tube being precisely aligned with a respective shell casing, as a result of said precise tolerance of said inner bore and a joining of said bullet and shell casing under influence of gravity, said feed tube further having means for allowing air to exit from said inner bore as each bullet drops through said feed tube, to facilitate passage of each bullet through said feed tube;

means for threading said feed tube to a progressive reloading press, said progressive reloading press comprising means for disposing a shell casing in a lower portion of said feed tube; and actuating means disposed between the feed tube and said reloading press for actuating release of bullets one at a time for passage through said feed tube to said shell casing.

10. The reloading apparatus of claim 9, wherein said actuating means for actuating release of bullets one at a time for passage through said feed tube comprises a chamber wherein a plurality of bullets are disposed in tandem, a pivotable lever disposed opposite said chamber, and a piston for engaging said pivotable lever and for causing said pivotable lever to pivot between a first, rest position and a second, release position.

11. The reloading apparatus of claim 10, wherein said chamber and said feed tube are offset from each other, with said actuating means further comprising a shuttle carrier engageable with said pivotable lever and being slidably movable between said chamber and said feed tube, said shuttle carrier having a cavity for receiving a bullet from said chamber when said pivotable lever is in said first, rest position, and for releasing said bullet to said feed tube when said pivotable lever is in said second, release position.

12. The reloading apparatus of claim 10, wherein said actuating means further comprises a first push pin and a second push pin, with each push pin engageable by said pivotable lever and extending into said chamber to engage a respective bullet disposed therein, said first push pin releasing a lowermost bullet disposed in said chamber, and said second push pin holding an adjacent bullet disposed above said lowermost bullet against release when said pivotable lever is in the second, release position, and said second push pin releasing said adjacent bullet to a position vacated by said lowermost bullet and said first push pin holding said adjacent bullet against release from said chamber when said pivotable lever is in the first, rest position.

13. The reloading apparatus of claim 10, wherein said pivotable lever further comprises a pawl having a first tooth and a second tooth, with each tooth extending into said chamber for engagement with a respective bullet disposed therein, said first tooth of said pawl releasing a lowermost bullet disposed in said chamber, and said second tooth of said pawl holding an adjacent bullet disposed above said lowermost bullet against release when said pivotable lever is in the second, release position, and said second tooth releasing said adjacent bullet to a position vacated by said lowermost bullet and said first tooth holding said adjacent bullet against release from said chamber when said pivotable lever is in the first, rest position.

14. A reloading apparatus for assembling ammunition, said reloading apparatus utilized in conjunction with a progressive reloading press, comprising:

a feed tube for accommodating the feeding of bullets of a given caliber, said feed tube having an inner bore of precise tolerance to said given caliber, wherein bullets can thereby drop through said feed tube one-at-a-time under the influence of gravity to a shell casing disposed in a lower portion of said feed tube, with each bullet dropping through said feed tube being precisely aligned with a respective shell casing, as a result of said precise tolerance of said inner bore and a joining of said bullet and shell casing under influence of gravity, said feed tube further having means for allowing air to exit from said inner bore as each bullet drops through said feed tube, to facilitate passage of each bullet through said feed tube, said feed tube being slidable with respect to said progressive reloading press and actuating release of bullets one-at-a-time for passage through said feed tube to said shell casing; and means for mounting said feed tube to a progressive reloading press, said progressive reloading press comprising means for disposing a shell casing in a lower portion of said feed tube, causing said feed tube to slide and actuate release of a bullet through said feed tube toward said shell casing.

15. The reloading apparatus of claim 14 further comprises a chamber wherein a plurality of bullets are disposed in tandem, said chamber being disposed above said feed tube, with a jacket for containing said chamber in juxtaposition with said feed tube, said feed tube being slidable within said jacket, a pivotable lever disposed opposite said chamber, with said feed tube being slidable into engagement with said pivotable lever and causing said pivotable lever via sliding to pivot between a first, rest position and a second, bullet release position.

16. The reloading apparatus of claim 15, wherein said pivotable lever further comprises a pawl having a first tooth and a second tooth, with each tooth extending into said chamber for engagement with a respective bullet disposed therein, said first tooth of said pawl releasing a lowermost bullet disposed in said chamber, and said second tooth of said pawl holding an adjacent bullet disposed above said lowermost bullet against release when said pivotable lever is in the second, release position, and said second tooth releasing said adjacent bullet to a position vacated by said lowermost bullet and said first tooth holding said adjacent bullet against release from said chamber when said pivotable lever is in the first, rest position, said feed tube slidably engaging said pivotable lever for movement between said first, rest position and said second, release position.

* * * * *